US008101879B2

(12) United States Patent
Nishino

(10) Patent No.: US 8,101,879 B2
(45) Date of Patent: Jan. 24, 2012

(54) KEY SWITCH AND KEYBOARD HAVING THE SAME

(75) Inventor: Takeshi Nishino, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 383 days.

(21) Appl. No.: 11/889,053

(22) Filed: Aug. 8, 2007

(65) Prior Publication Data

US 2008/0035461 A1 Feb. 14, 2008

(30) Foreign Application Priority Data

Aug. 11, 2006 (JP) ..... 2006-220072

(51) Int. Cl.
*H01H 13/70* (2006.01)

(52) U.S. Cl. ..... 200/344; 200/5 A

(58) Field of Classification Search ..... 400/490, 400/495, 495.1, 496; 200/5 A, 341, 344, 200/345

See application file for complete search history.

(56) References Cited

U.S. PATENT DOCUMENTS

| | | | | |
|---|---|---|---|---|
| 6,586,695 | B2 * | 7/2003 | Sato et al. | 200/344 |
| 2003/0057080 | A1 | 3/2003 | Sato et al. | |

FOREIGN PATENT DOCUMENTS

| | | |
|---|---|---|
| JP | 11-3628 | 1/1999 |
| JP | 2001-184980 | 7/2001 |
| JP | 2003-92041 | 3/2003 |
| JP | 2004-139752 | 5/2004 |
| JP | 2006-49274 | 2/2006 |

OTHER PUBLICATIONS

Chinese Patent Office Action dated Aug. 10, 2010 for corresponding Chinese Patent Application No. 200710140883.6.

Japanese Patent Office Notice of Reasons for Rejection mailed Feb. 18, 2011 for corresponding Japanese Patent Application No. 2006-220072.

Japanese Office Action issued Jul. 12, 2011 in corresponding Japanese Patent Application 2006-220072.

* cited by examiner

*Primary Examiner* — Renee Luebke
*Assistant Examiner* — Marina Fishman
(74) *Attorney, Agent, or Firm* — Staas & Halsey LLP

(57) ABSTRACT

A gear-link type key switch including a pair of link members on a base panel, wherein the key switch has a constitution in that the pair of link members are not disengaged when a key top is attached to the link members. Furthermore, the key switch alleviates the need for an undesired attaching method because of its structure, when a key top is attached to the link members. In order to prevent the pair of link members from disengaging in an anteroposterior direction, wall members are provided on the base panel of the key switch. The wall members arranged on opposite sides of a contact section of the link members, abutting the outside of pivoting shafts, are made by cutting the plate member of the base panel and pulling up the cut plate member, and are an integral part of the plate member.

6 Claims, 12 Drawing Sheets

KEY SWITCH AND KEYBOARD HAVING THE SAME

BACKGROUND OF THE INVENTION

1. Field of the Invention

The present invention relates to a switch configuration for key-entry operation, and more particularly, to a key-entry switch device (hereinafter referred to as a key switch) preferably used for a keyboard incorporated, as an input device in electronic equipment. The present invention also relates to a keyboard provided with key switches.

2. Description of the Related Art

In a portable electronic apparatus, such as a notebook or palm-top personal computer, various arts have been proposed to improve the operability of the key switch for realizing a reduction in the height of a package including the keyboard. Especially, to reduce the height of the keyboard including a plurality of key switches for a key-entry operation, it is necessary to reduce the height of a key switch when it is depressed (switch-on) as well as in an inoperative position (switch-off) while maintaining a predetermined amount of stroke of the key switch large enough to provide a certain level of operability of the key switch.

Conventionally, a key-switch used for a thinner or low-profile-type keyboard includes a base panel; a key top arranged above the base panel; a pair of link members interlocked to each other, to support the key top above the base panel and direct the key top in a vertical direction; a switch mechanism capable of opening and closing a contact section at a position corresponding to the key top. A pair of link members are assembled together into a reverse V-shape as seen from a lateral direction (or in a side view), engaged with the base panel slidably at the first end region, engaged each other at the second end region and pivotally joined to the key top, which may be referred to as a gear-link type (see, e.g., Japanese Unexamined Patent Publication (Kokai) No. 11-3628 (JP-A-11-3628)). Also, a new gear-link type constitution for a low-profile-type keyboard with increased stroke has been proposed (see, e.g., Japanese Unexamined Patent Publication (Kokai) No. 2006-049274 (JP-A-2006-049274)). This type includes a wall portion extending from a plate member of the base panel, the sliding parts of the pair of link members are slidably engaged with the guide grooves of the wall portions, and the pivoting shafts of the link members are pivotally joined to the pivot support sections of the key top.

In the gear-link type described in JP-A-2006-049274, before attaching the key top to the pair of link members, only four wall portions of the base panel hold the pair of link members. Namely, the pair of link members is held between the wall portions. However, a certain amount of clearance must be provided between the wall portions and the pair of link members. Therefore, the pair of link-members is not immovably retained by the wall portions.

A relative displacement of the pair of link members may occur due to accidental contact of the key top with the pair of link members upon attachment of the key top. As a result, in some cases, the gear portions of the pair of link members that have engaged with each other disengage from one another. The key top attached to the pair of link members which have been relatively displaced exerts an unreasonable amount of force upon the link members, Consequently, in the worst case, the sliding parts of the link members may be disengaged from the guide grooves of the wall portions.

When an operator attaches the key top to the pair of link members, a first pair of pivot support sections provided on one side of the key top is first engaged with corresponding pivoting shafts of the pair of link members, and thereafter engages a second pivot support sections provided on the other side of the key top with the corresponding pivoting shafts of the pair of link members. In this assembly method, there is the fear that the pair of link members are undesirably damaged.

It is difficult for a user to prevent attaching the key top to the pair of link members in the undesirable assembly method as mentioned above, in the gear-link type as described in JP-A-2006-049274.

SUMMARY OF THE INVENTION

The object of the present invention is to provide a key switch having a pair of link members of a gear-link type, wherein the key switch has a constitution for preventing displacement of link members when attaching a key top to the pair of link members.

Another object of the present invention is to provide a key switch apparatus which is configured to limits the degree of freedom of operation to some extent, wherein a plurality of pivoting support sections of the key top are engaged by a plurality of corresponding pivoting shafts of the pair of link members substantially at one time.

In order to accomplish the above objects, the present invention provides a key switch and keyboard having the following features.

The present invention provides a key switch comprising a base panel; a key top arranged above the base panel; a pair of link members interlocked to each other to support the key top above the base plate and direct the key top in a vertical direction, the pair of link members having gear portions engaged with each other and pivoting shafts engaging the key top, the key top having pivot support sections pivotally engaging the pivoting shafts; a switch mechanism capable of opening and closing a contact section of an electric circuit in accordance with a vertical movement of the key top; and a displacement preventing mechanism for preventing the gear portions engaged with each other from being displaced relative to each other due to on attaching the key top to the pair of link members.

In the above key switch, the displacement preventing mechanism may include new wall members provided on the base panel at an opposite side of the contact section of the switch mechanism in relation to the pair of link members and at an outside of the pivoting shafts of the pair of link members.

Also, the displacement preventing mechanism may include wall portions provided on the base panel on a same side of the contact section in relation to the pair of link members and on an inside of the pivoting shafts of the link members.

Each pair of link members may include a plurality of the sliding parts and slits formed between the sliding parts, and the displacement preventing mechanism may include wall members provided on the base panel and each of the wall members can engage to corresponding slit.

In the above key switch, the wall members and the base panel may be formed integrally.

The above displacement preventing mechanism may be comprised of the pivoting shafts of the pair of link members positioned at the adjacent side of the contact section.

The present invention also provides a keyboard comprising a plurality of key switches as described above.

BRIEF DESCRIPTION OF THE DRAWINGS

The above and other objects, features and advantages of the present invention will become more apparent from the following description of the preferred embodiments in connection with the accompanying drawings, wherein:

FIG. 15 B is a plan view of the pair of link members of FIG. 13;

DESCRIPTION OF THE PREFERRED EMBODIMENT

Figure 1:
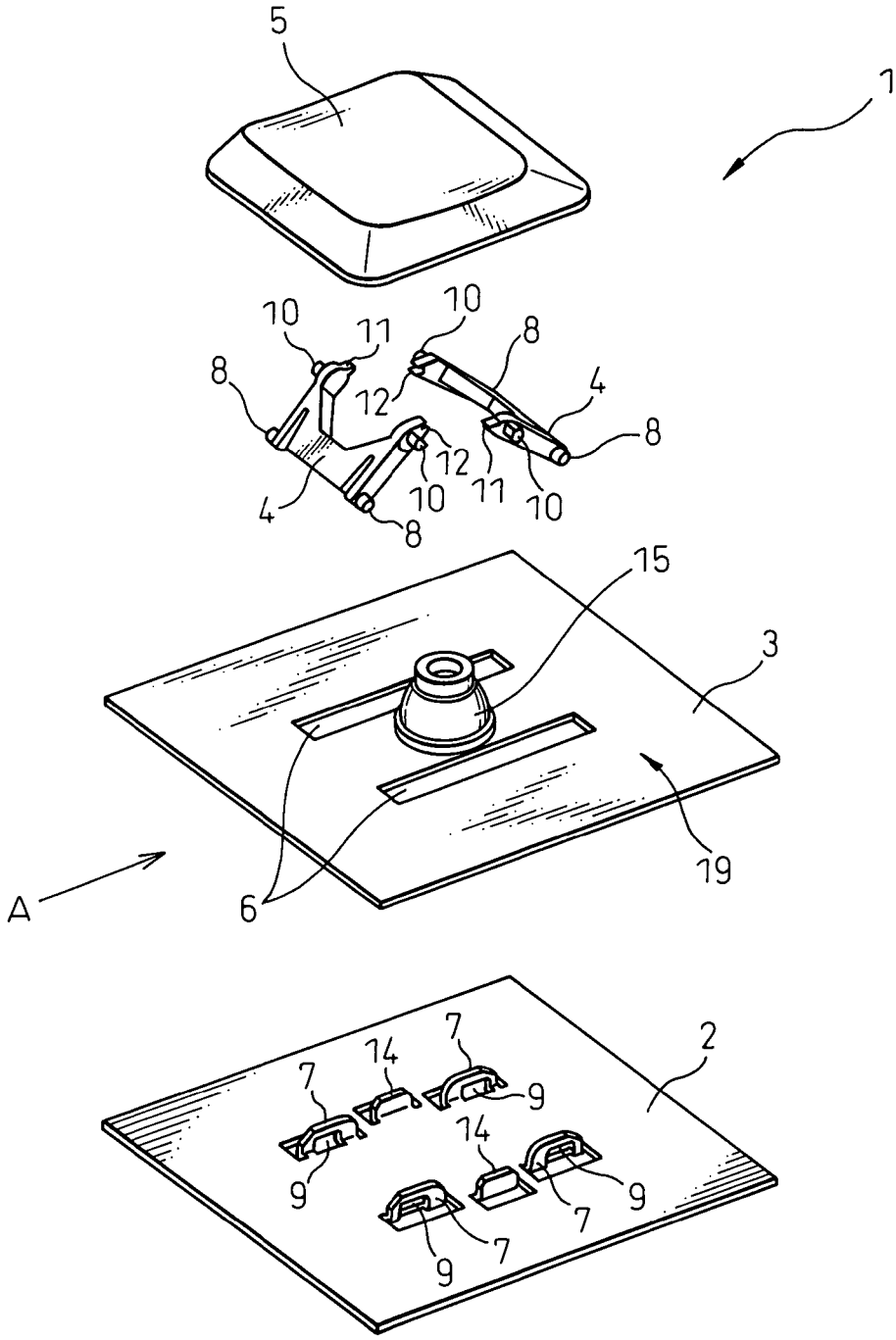
FIG. 1 is an exploded perspective view showing a key switch according to the present invention.

The embodiments of the present invention are described below in detail, with reference to the accompanying drawings. In the drawings, the same or similar components are denoted by common reference numerals.

Figure 2:
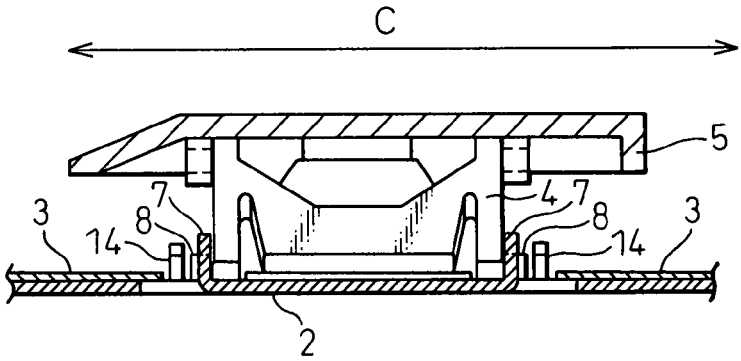
FIG. 2 is a partial sectional view seeing from direction A of FIG. 1, showing the key switch of FIG. 1 in an assembled state with a key top of the key switch not pushed down.
Figure 3:
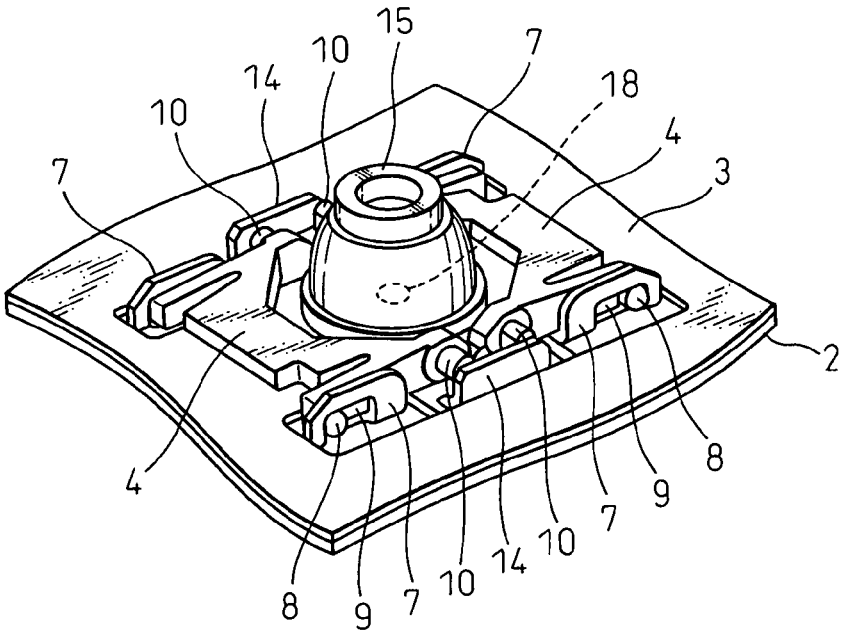
FIG. 3 is a perspective and partial transparent view of the key switch of FIG. 1 in an assembled state, without the key top.
Figure 4:
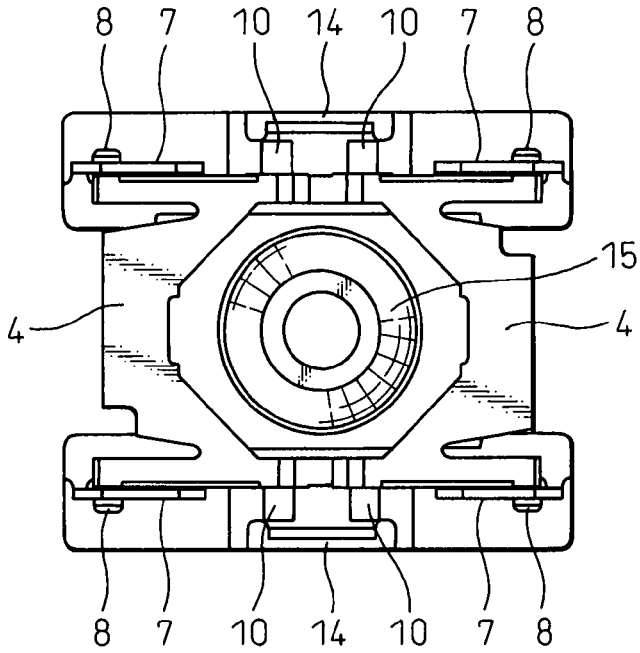
FIG. 4 is a plan view of the key switch of FIG. 1 in an assembled state, except for the key top.
Figure 5:
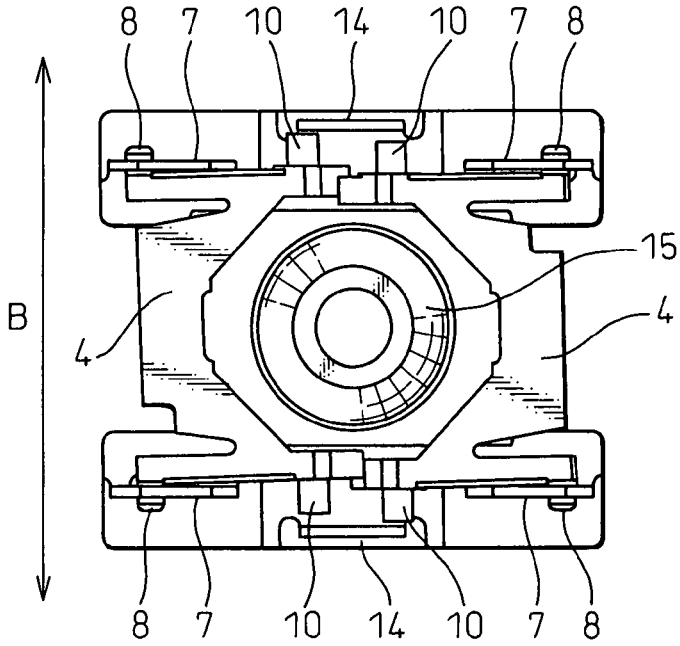
FIG. 5 is a plan view of the key switch of FIG. 1 in an assembled state, without the key top, showing the maximum gap in an anteroposterior direction of the pair of link members.
Figure 6:
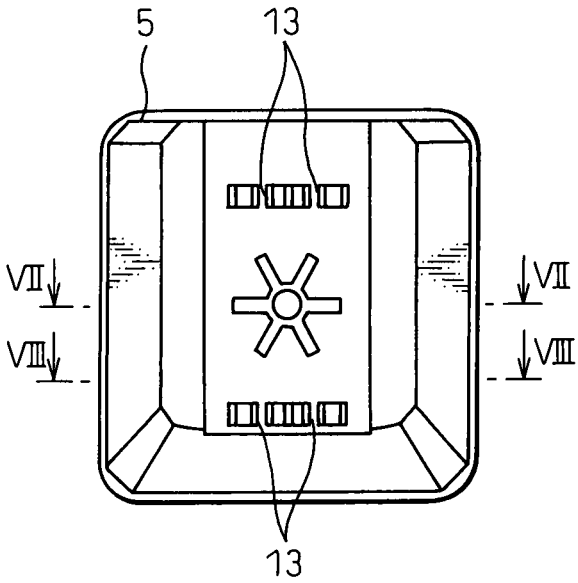
FIG. 6 is rear view of the key top.
Figure 7:
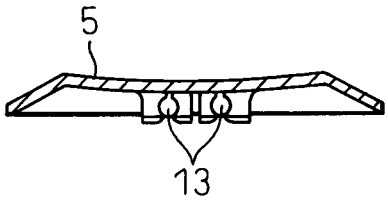
FIG. 7 is a sectional view of the key top taken along line VII-VII of FIG. 6.
Figure 8:
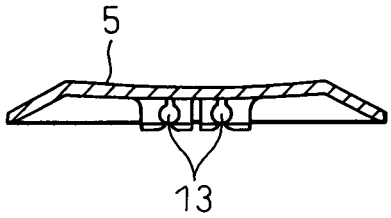
FIG. 8 is a sectional view of the key top taken along line VIII-VIII of FIG. 6.

In reference to the drawings, FIG. 1 is an exploded perspective view showing a key switch 1 according to a first embodiment of the present invention, FIG. 2 is a partial sectional view seen from direction A of FIG. 1, showing the key switch 1 of FIG. 1 in an assembled state with a key top of the key switch not pushed down, FIG. 3 is a perspective and partial transparent view of the key switch 1 of FIG. 1 in an assembled state, without the key top 5, FIG. 4 is a plan view of the key switch 1 of FIG. 1 in an assembled state, without the key top 5, FIG. 5 is a plan view of the key switch of FIG. 1 in an assembled state, without the key top 5 showing the maximum gap of an anteroposterior direction (Direction B of this Fig.) of the pair of link members, FIG. 6 is rear view of the key top 5, FIG. 7 is a sectional view of the key top 5 taken along line VII-VII of FIG. 6, and FIG. 8 is a sectional view of the key top 5 taken along line VIII-VIII of FIG. 6.

As shown in FIG. 1, a key switch 1 includes a base panel 2, a key top 5 arranged above the base panel 2, a pair of link members 4 interlocked to each other to support the key top 5 above the base panel 2 and which direct the key top 5 in a vertical direction; and a switch mechanism capable of opening and closing a contact section 18 (refer to FIG. 3) of an electric circuit in accordance with vertical movement of the key top 5; each pair of link members 4 has two sliding shafts 8 slidably engaging the base panel 2, and the base panel 2 has four wall portions 7 as slide support sections slidably engaging the sliding shafts 8. The pair of link members 4 has gear portions comprising a concave gear portion 12 and a convex gear portion 11 pivotally engaged with each other. Each of the pair of link members 4 has four pivoting shafts 10 engaging with the key top 5. The key top has pivot support sections 13 pivotally engaging with the pivoting shafts 10. The switch mechanism 19 comprises membrane switch sheet 3 and rubber dome 15. Through-holes 6 provided on the membrane switch sheet 3 at regions corresponding to the pair of link members 4. The sliding parts 8 of the pair of link members 4 are slidably moved on through-holes 6 of the membrane sheet 3 along and in guide grooves 9 formed in the wall portions 7 of the base panel 2 that extend through the through-holes 6. The key switch 1 includes the displacement preventing mechanism of the gear portions, which prevents displacement of the gear portions comprising a concave gear portion 12 and a convex gear portion 11 engaged with each other when attaching the key top 5 to the pair of link members 4. This displacement preventing mechanism includes wall members 14 provided on the base panel 2 at the opposite side of the contact section 18 of the switch member 19 in relation to the pair of link members 4 and abutting the pivoting shafts 10 of each pair of link members 4 (i.e. on the outside of the pair of link members 4).

The outline of the way of the assembling the key switch 1 is explained as follows. A membrane switch sheet 3 is located on the base panel 2 in the FIG. 1. The link member 4 are planarly located on the base panel 2 (FIG. 3), so that the pivoting shafts 8 of the pair of link members 4 are inserted into the guide grooves 9 of the wall portions 7 and the convex gear portions 11 are engaged in the concave gear portions 12.

Next, the key top 5 is attached from above onto the link members 4 so that the four pivot support sections 13 of the key top 5 are engaged by the four pivoting shafts 10 of the link members 4.

In this case, wall members 14 are integrally arranged on the base panel 2. The wall members 14 are made by cutting the plate member of the base panel 2 and pulling up the cut plate member and positioning it at the opposite side of the contact section 18 of the switch mechanism 19 in relation to the wall portions 9, and outside of the pivoting shafts 10 of the pair of link members 4.

The gap of an anteroposterior direction of the pair of link members 4 (refer to the direction C of FIG. 2) can be limited by the wall members 14 (FIG. 5 shows the gap of the pair of link members limited by the wall members 14 and the pair of link members 4 not disengaged.). Also, these wall members 14 become the guide of the pivot support sections 13 when fitting the key top 5 in the pair of link members 4. Furthermore, the wall members 14 provided outside of the concave gear portion 12 and the convex gear portion 11 make it impossible to first, engage the first pair of pivot supports sections 13 (FIG. 6) provided on one side of the key top 5 with the corresponding pivoting shafts 10 provided on one side of the pair of link members 4, and then engage the second pair of pivot support sections provided on the other side of the key top 5 with the corresponding pivoting shafts 10 provided on the other side of the link members 4, when the key top 5 is attached to the pair of link members 4, when the key top 5 is attached to the pair of link members 4.

Instead of such a key top attaching method which is undesirable from the structural view point, the four pivot support sections 13 of the key top 5 can be attached to the four pivoting shafts 10 of the pair of link members 4, substantially at one time.

FIGS. 9 to 12 show a key switch 60 according to a second embodiment of the present invention. The key switch 60 has a configuration substantially identical to the key switch 1 according to the first embodiment, except that the wall members 64 are different from that of the key switch 1. The corresponding components are denoted by common reference numerals, and the explanation thereof is not repeated.

Figure 9:
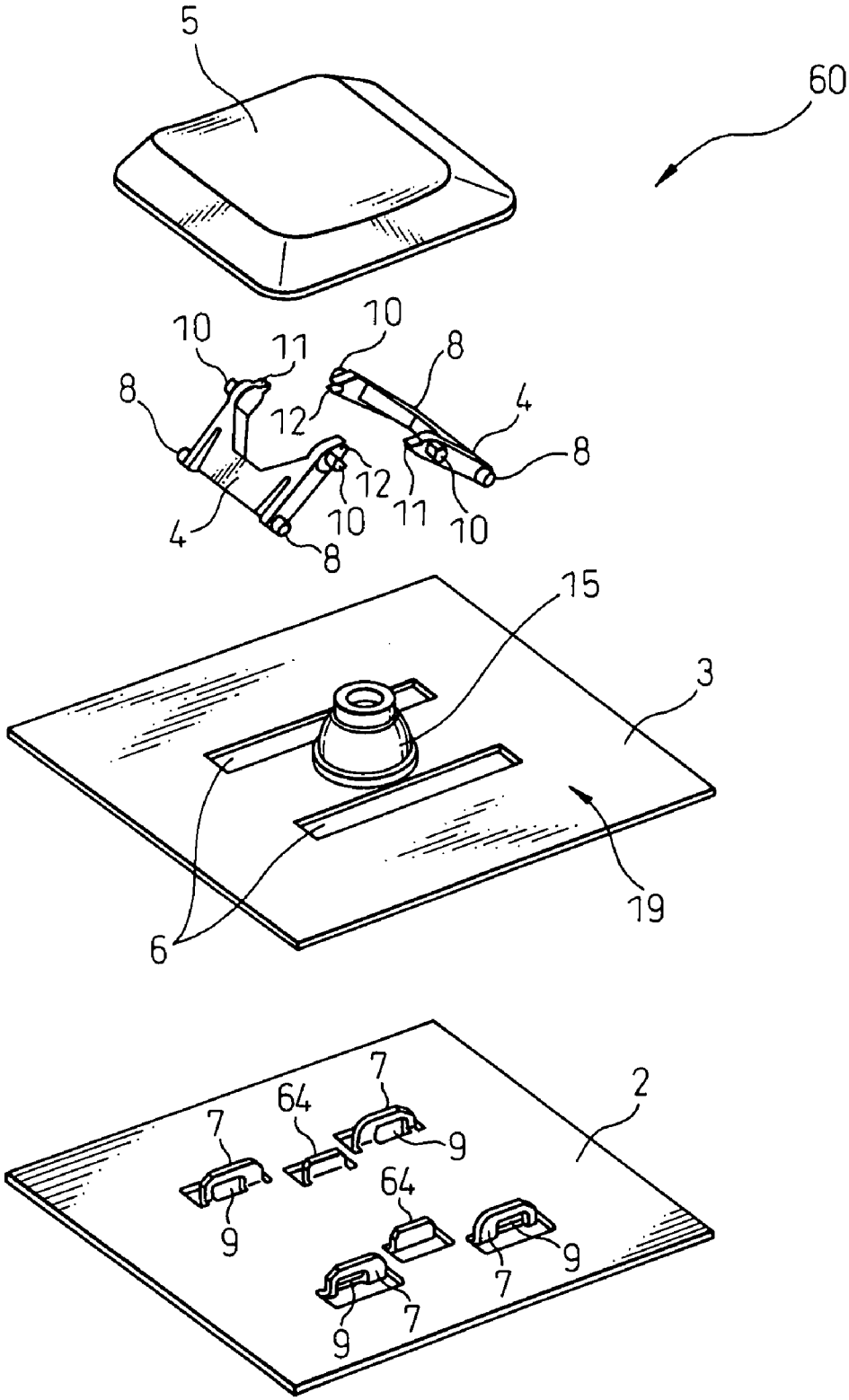
FIG. 9 is an exploded perspective view of another key switch of the present invention.
Figure 10:
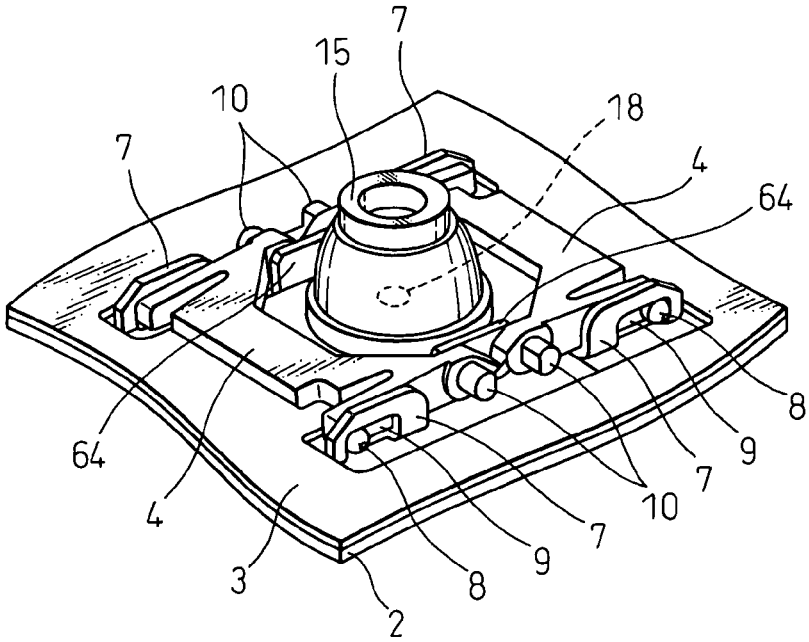
FIG. 10 is a perspective partial transparent view of the key switch of FIG. 9 in an assembled state, without the key top.
Figure 11:
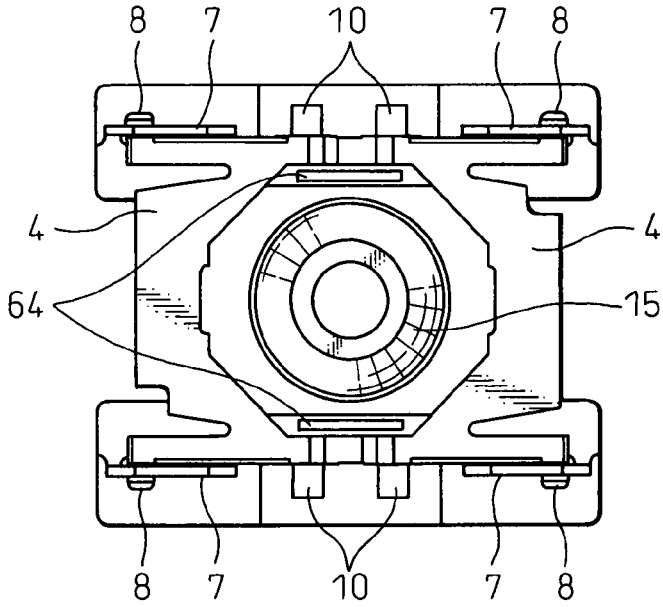
FIG. 11 is a plan view of the key switch of FIG. 10 in an assembled state, without the key top.

As shown in FIG. 9, displacement preventing mechanism includes wall members 64 provided on the base panel 2 on the same side of the contact section 18 in relation to the pair of link members 4, and on the adjacent side of the root portion of the pair of link members 4 (i.e. inside of the pair of link members 4).

Figure 12:
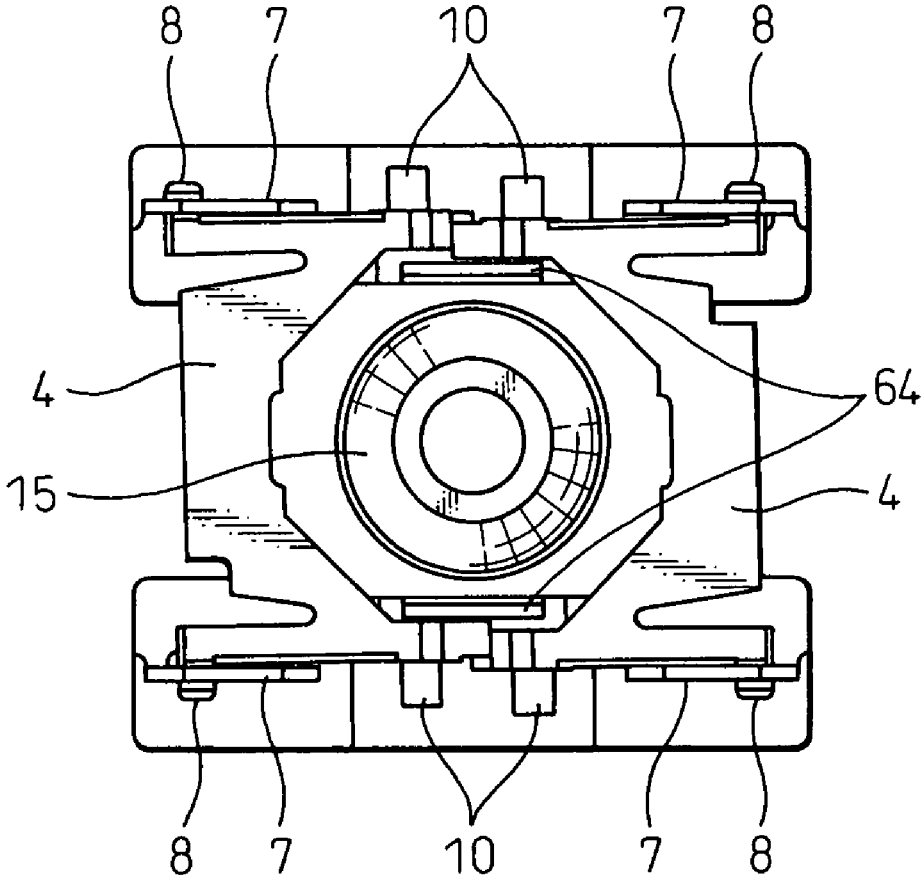
FIG. 12 is a plan view of the key switch of FIG. 9 in an assembled state, without the key top showing the maximum gap of an anteroposterior direction of the pair of link members.

The gap of the anteroposterior direction of the pair of link members 4 (refer to the direction C of FIG. 2) can be limited by the wall members 64 (FIG. 12 shows the gap of the pair of link members limited by the wall members 64 and the pair of link members 4 are not disengaged.). Also, these wall members 64 becomes the guide of the pivot support sections 13 when fitting the key top 5 in the pair of link members 4. It is necessary for the rubber dome 15 to be small, because the wall members 64 have to be provided on the same side of the contact section 18 in relation to the pair of the link members 4.

Figure 13:
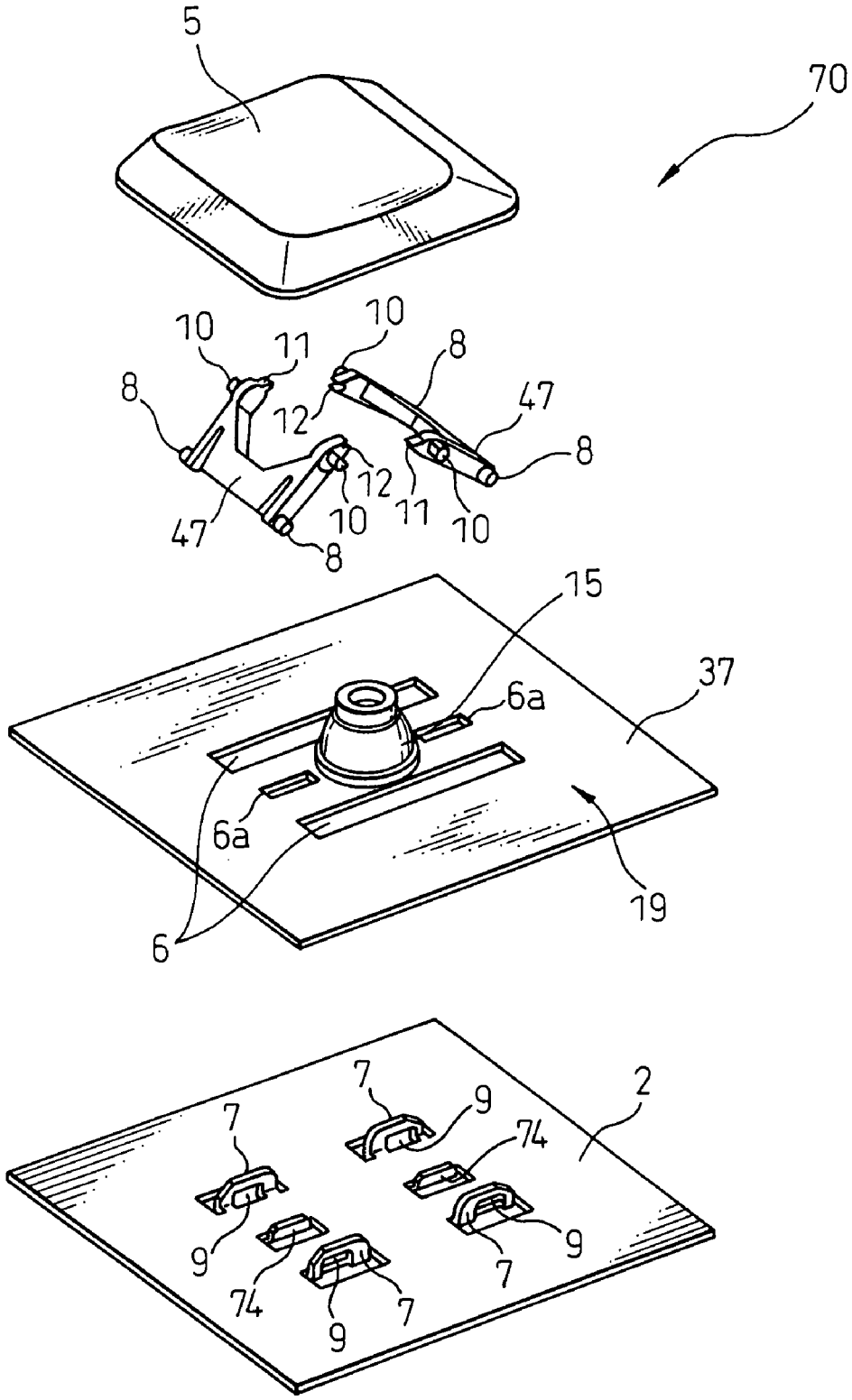
FIG. 13 is an exploded perspective view of another key switch of the present invention.
Figure 14:
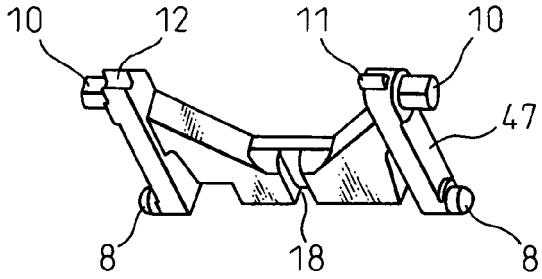
FIG. 14 is a perspective view of the pair of link members of FIG. 13.
Figure 15A:
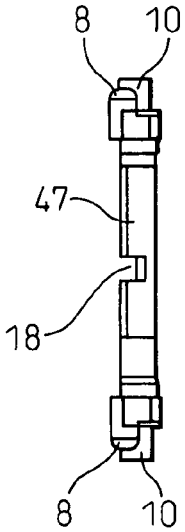
FIG. 15 A is an elevation view of the pair of link members of FIG. 13.
Figure 15B:
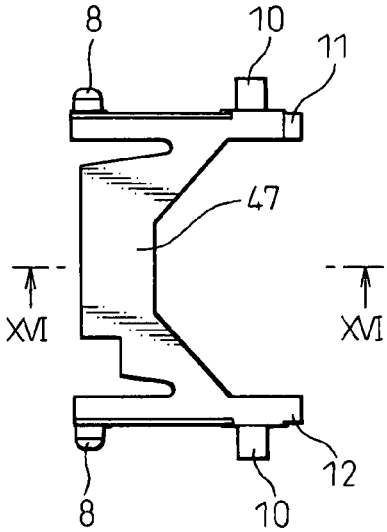
Figure 16:
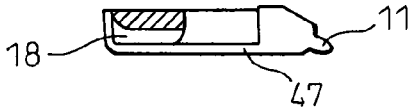
FIG. 16 is a sectional view taken along a line XVI-XVI of the pair of link members of FIG. 15B.

FIG. 13 shows a key switch 70 according to a third embodiment of the present invention. The key switch 70 has a configuration substantially identical to the key switch 1 according to the first embodiment, except that the pair of link members 47, the wall members 74 and the membrane switch sheet 37 are different from those of the key switch 1. The corresponding components are denoted by common reference numerals, and an explanation thereof is not repeated. FIG. 14 is a perspective view of the pair of link members 47 of FIG. 13, FIG. 15 A is an elevation view of the pair of link members of FIG. 13, FIG. 15 B is a plan view of the pair of link members of FIG. 13 and FIG. 16 is a sectional view taken along line XVI-XVI of the pair of link member 47.

As shown in FIG. 13, each of a pair of the link members 47 includes two sliding shafts 8 as sliding parts and slits 18 formed between the sliding shafts 8 (refer to FIG. 14). The displacement preventing mechanism includes wall members 74 provided on the base panel 2 and each of the wall potions 74 can engage the corresponding slit 18.

Furthermore, the through-holes 6*a* are provided on the membrane switch sheet 37 to protrude through the wall members 74 from the through-holes 6*a*.

The wall part 74 is integrally arranged by cutting the plate member of the base panel 2 and pulling up the cut plate member. The gap of the anteroposterior direction of the opposite pair of the link members 47 can be limited by engaging these wall members 74 to the slit 18 of the link member 47. In order to provide wall members 74 between the wall portions 7, it is necessary for the rubber dome 15 or the wall members 74 to be small. Furthermore, because the wall members 74 are spaced from the concave gear portion 12 and the convex gear portion 11, the engagement of the wall members 74 with the slits 18 is weaker than that in the first or second embodiment.

Figure 17:
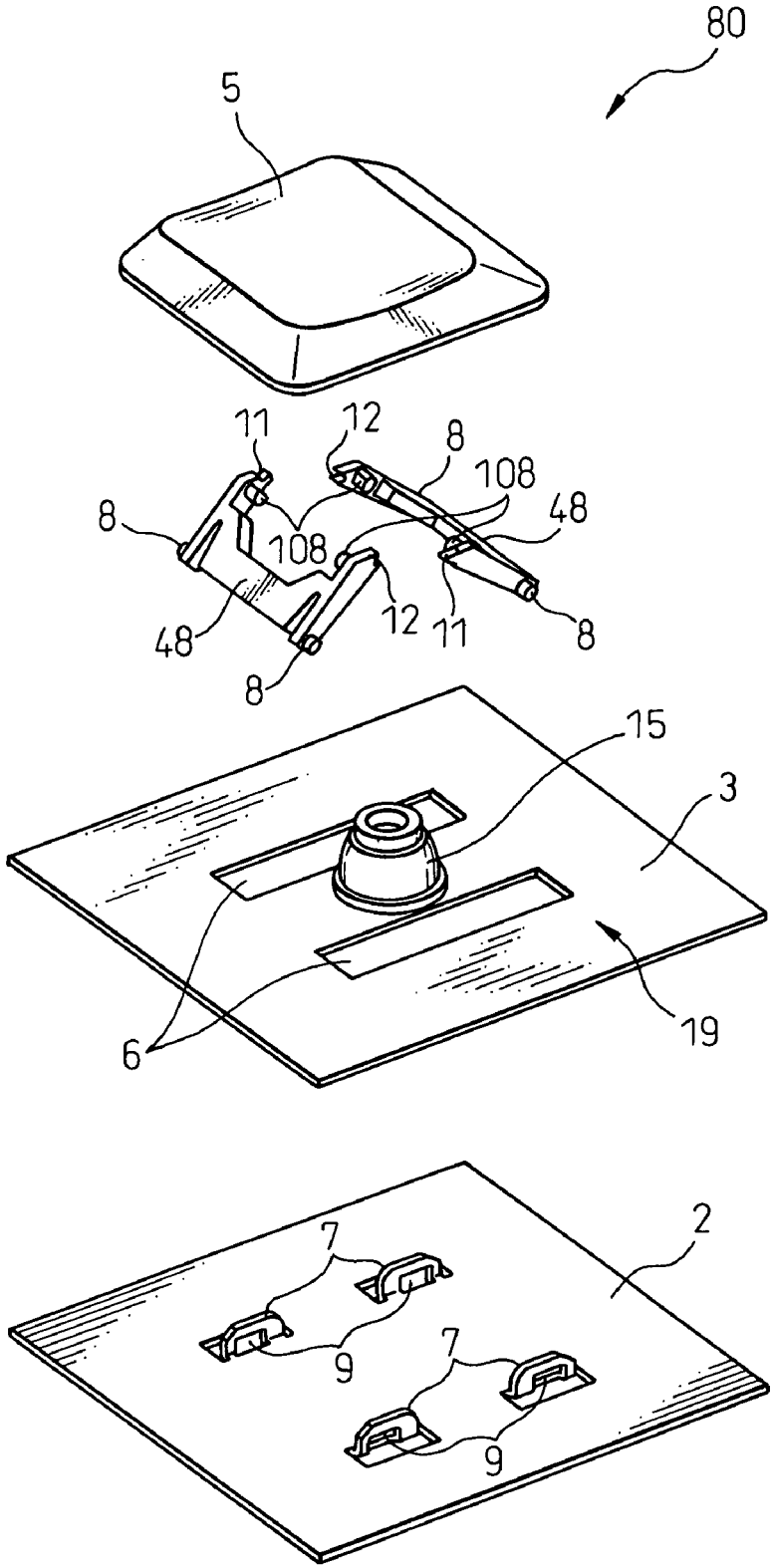
FIG. 17 is a exploded perspective view of the another key switch of the present invention.
Figure 18:
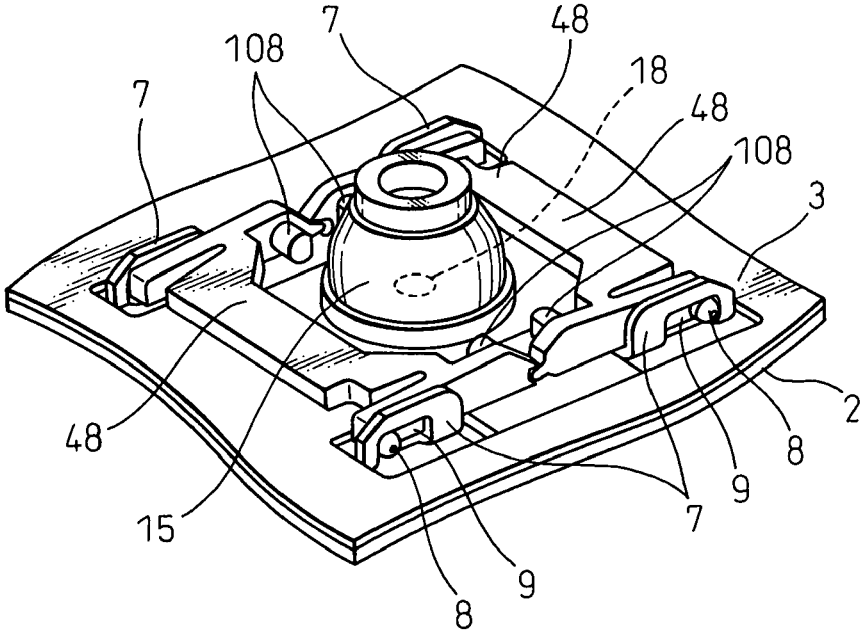
FIG. 18 is a perspective partial transparent view of FIG. 17 in an assembled state, without the key top.
Figure 19:
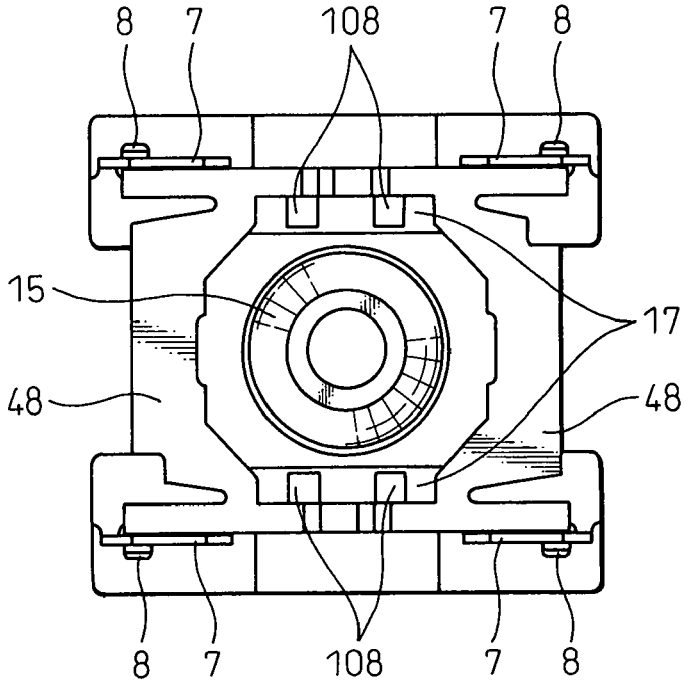
FIG. 19 is a plan view of the key switch of FIG. 17 in an assembled state without the key top.

FIGS. 17 to 19 show a key switch 80 according to a fourth embodiment of the present invention. The key switch 80 has a configuration substantially identical to the key switch 1 according to the first embodiment, except that the wall members 14 in the key switch 1 are omitted, and the pivoting shafts 108 of the pair of link members 48 are different from those of the key switch 1 of the first embodiment. The corresponding components are denoted by common reference numerals, and an explanation thereof is not repeated.

The displacement preventing mechanism comprised of the pivoting shafts 108 as the pivoting portion of the pair of link members 48 positioned at the adjacent sides of the contact section 18 of the switching mechanism 19.

In the aforementioned embodiments, the pivoting shafts 10 of the pair of link members 4, 47 are arranged on the opposite side of the contact section 18 in relation to the pair of link members 4, 47. Therefore, in the case of FIG. 9 and FIG. 13, when attaching the key top 5 to the pair of link members 4,47, if the undesired attaching method was used, in which a pair of pivot support sections 13 of one side of the key top 5 are engaged with the corresponding pivoting shafts 10 of a pair of link members 4,47, and a pair of pivot sections 10 of another side of the key top 5 are engaged with the corresponding pivoting shafts 10 of a pair of link members 4, then when fitting the key top 5 in the pair of link members 4, there is a disadvantage in that the concave gear portion 12 and the convex gear portion 11 may be broken. To avoid this, it is necessary, instead of using the above undesired attaching method, to attach the pivot support section 13 of the key top 5 to the pivoting shafts 10 of the pair of link members 4 from above the pair of link members 4.

In this embodiment, because the pivoting shafts 108 of the pair of link members 48 are not arranged on the opposite sides of the contact section 18, but on the same side of the contact section 18 (refer to FIG. 18) of the switch mechanism 19 in relation to the pair of link members 48, it is not necessary to use the above undesired attaching method. When attaching the key top 5 to the pair of link members 48, the pair of link members 48 are stable, preventing the displacement between the concave gear portion 12 and the convex gear portion 11. Since the key top 5 is inserted in to the vacant area 17 of FIG. 19, which appears rectangular when seen from above, it is easy to decide the relative positioning of the pair of link members 48 in relation to the key top 5. Furthermore, because the constitution of the plate member is thinner than the mold constitution (for example, in the case of a plastic casting), it is difficult to form the wall members 14, 64, 74 (refer to FIG. 1, FIG. 9 and FIG. 13) in order to position the pair of link members 4, 47 as described in the aforementioned embodiments. However, this embodiment has the advantage of not forming the wall members 14, 64 and 74.

Figure 20:
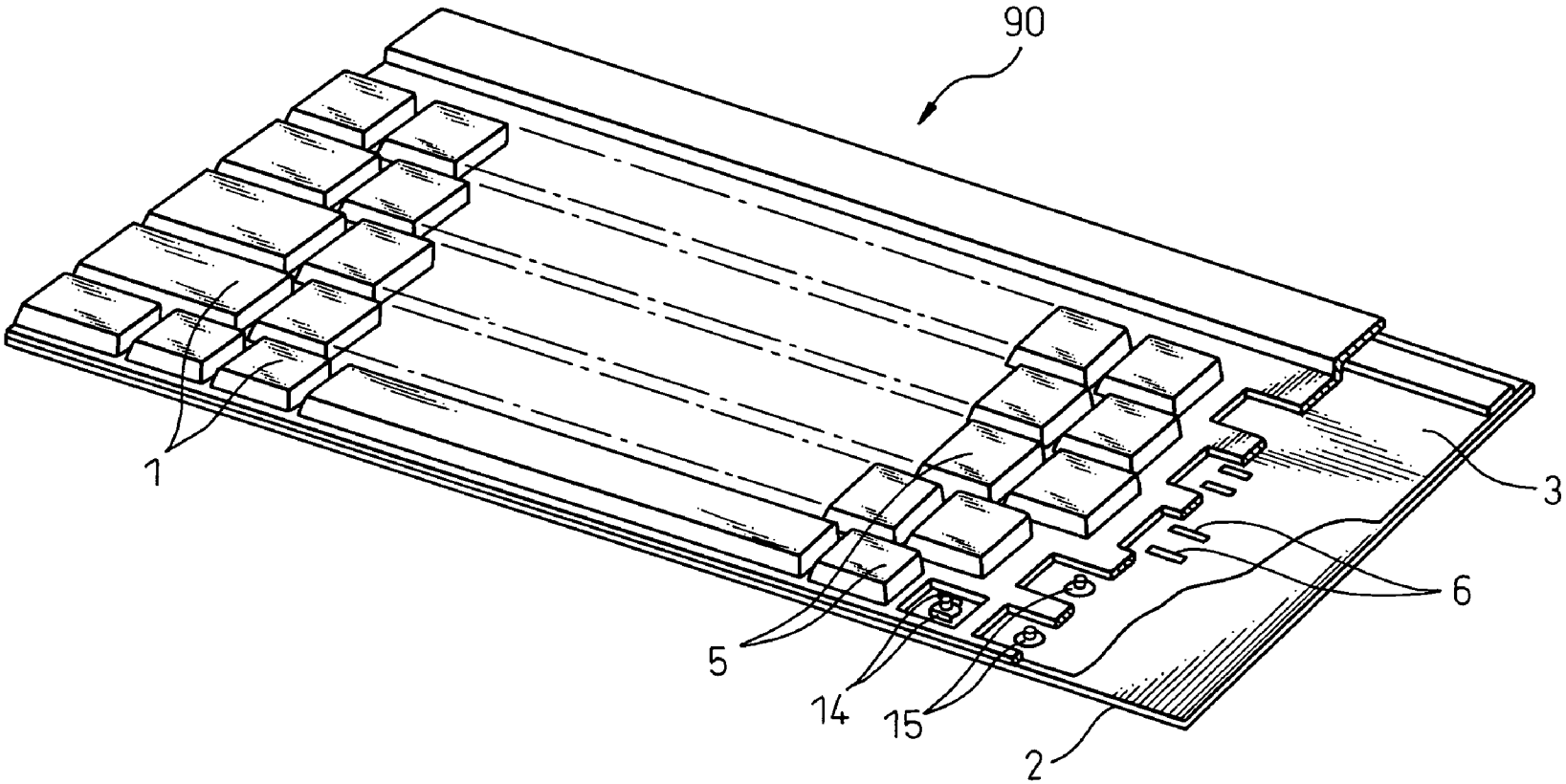
FIG. 20 is a partial cutaway perspective view showing a key board according to an embodiment of the present invention, comprising several key switches arranged in desired positions on the key board.

FIG. 20 is a partial cutaway perspective view showing a key board 90 according to the first embodiment of the present invention, comprising several key switches 1 arranged in desired positions on the keyboard. The key board 90 has key switches 1 comprising wall members 14 that prevent displacement of the pair of link members 4 when attaching the key top 5, and prevent the undesired attaching method because of its structure. Therefore, it is difficult for the key top to become disengaged from the pair of link members 4 with use, and the pair of link members 4 is unlikely to break.

While the invention has been described with reference to specific preferred embodiments, it will be understood, by those skilled in the art, that various changes and modifications may be made thereto without departing from the sprit and scope of the claims.

The invention claimed is:

1. A key switch comprising a base panel;

an attachable key top arranged above the base panel;

a pair of link members to which the key top attaches so that, when the key top is attached to the pair of link members, the pair of link members interlock to each other to support the attached key top above the base panel and direct the attached key top in vertical movement in a vertical direction, the pair of link members having gear portions engaged with each other and pivoting shafts engaging the attached key top, the attached key top having pivot support sections pivotally engaging the pivoting shafts;

a switch mechanism capable of opening and closing a contact section of an electric circuit in accordance with the vertical movement of the attached key top; and a displacement preventing mechanism which prevents the gear portions engaged with each other from being displaced relative to each other when attaching the key top to the pair of link members, wherein the displacement preventing mechanism includes wall members provided on the base panel, the wall members being configured as a guide of the pivot support sections when the key top is attached to the pair of link members.

2. A key switch as set forth in claim 1, wherein the displacement preventing mechanism includes the wall members provided on the base panel at opposite sides of the contact section and outside of the pivoting shafts of the pair of link members.

3. A key switch as set forth in claim 1, wherein the displacement preventing mechanism includes the wall members provided on the base panel on a same side of the contact section and on an inside of the pivoting shafts of the link members.

4. A key switch as set forth in claim 2, wherein the wall members and the base panel are integrally formed.

5. A key switch as set forth in claim 3, wherein the wall members and the base panel are integrally formed.

6. A keyboard comprising a plurality of key switches, each being as set forth in claim 1.

* * * * *